US008648687B2

(12) United States Patent
Li et al.

(10) Patent No.: US 8,648,687 B2
(45) Date of Patent: Feb. 11, 2014

(54) SYMMETRIC PLANAR TRANSFORMER HAVING ADJUSTABLE LEAKAGE INDUCTANCE

(75) Inventors: Dong-Sheng Li, Tamshui Chen (TW); Huai-Shen Tsai, Tamshui Chen (TW); Wei-Liang Lin, Tamshui Chen (TW); Sheng-Chih Chang, Tamshui Chen (TW)

(73) Assignee: Acbel Polytech Inc., Taipei Hsien (TW)

( * ) Notice: Subject to any disclaimer, the term of this patent is extended or adjusted under 35 U.S.C. 154(b) by 596 days.

(21) Appl. No.: 12/972,738

(22) Filed: Dec. 20, 2010

(65) Prior Publication Data

US 2012/0154095 A1 Jun. 21, 2012

(51) Int. Cl.

| | |
|---|---|
| ***H01F 27/30*** | (2006.01) |
| ***H01F 5/00*** | (2006.01) |
| ***H01F 17/04*** | (2006.01) |

(52) U.S. Cl.

USPC ..... 336/199; 336/198; 336/200; 336/207; 336/208; 336/221

(58) Field of Classification Search

USPC ..... 336/199, 198

See application file for complete search history.

(56) References Cited

U.S. PATENT DOCUMENTS

| | | | | |
|---|---|---|---|---|
| 5,565,837 | A * | 10/1996 | Godek et al. | 336/232 |
| 5,631,822 | A * | 5/1997 | Silberkleit et al. | 363/144 |
| 6,636,140 | B2 * | 10/2003 | Fujiyoshi et al. | 336/200 |
| 6,727,793 | B2 * | 4/2004 | Piechnick | 336/198 |
| 6,734,775 | B2 * | 5/2004 | Chung | 336/198 |
| 6,831,544 | B2 * | 12/2004 | Patel et al. | 336/200 |
| 7,091,817 | B2 * | 8/2006 | Peck et al. | 336/208 |
| 7,236,077 | B1 | 6/2007 | Hsu | |
| 7,414,510 | B1 * | 8/2008 | Cheng | 336/200 |
| 8,164,408 | B2 * | 4/2012 | Kim | 336/200 |
| 2002/0057178 | A1 * | 5/2002 | Timashov et al. | 336/208 |
| 2007/0152795 | A1 * | 7/2007 | Zeng et al. | 336/212 |
| 2010/0219926 | A1 * | 9/2010 | Willers et al. | 336/200 |

* cited by examiner

*Primary Examiner* — Alexander Talpalatski
*Assistant Examiner* — Ronald Hinson
(74) *Attorney, Agent, or Firm* — Rabin & Berdo, P.C.

(57) ABSTRACT

A symmetric planar transformer having adjustable leakage inductance has a circuit board, two first bobbins mounted respectively on opposite side surfaces of the circuit board, two primary windings mounted respectively on the first bobbins, two secondary windings disposed respectively between the circuit board and the first bobbins, two second bobbins disposed respectively between adjacent first bobbins and primary windings, two pad sets disposed respectively between adjacent first bobbins and second bobbins, and a magnetic core assembly mounted through the circuit board, the first and second bobbins, the secondary and primary windings and the pad sets. Adjusting the numbers of the at least one pad of each pad set also adjusts distances between the primary and secondary windings to allow the secondary windings to have the same leakage. Thus, a balanced electric current is induced.

9 Claims, 17 Drawing Sheets

SYMMETRIC PLANAR TRANSFORMER HAVING ADJUSTABLE LEAKAGE INDUCTANCE

BACKGROUND OF THE INVENTION

1. Field of the Invention

The present invention relates to a transformer, especially to a symmetric planar transformer having adjustable leakage inductance.

2. Description of the Prior Art(s)

A transformer is a device that transfers electrical energy from one circuit to another circuit through inductively coupled conductors (a primary winding, a secondary winding and a magnetic core of the transformer). Imperfect coupled primary and secondary windings of a conventional transformer have a coupling coefficient less than 1 so that a leakage inductance occurs. Since the leakage inductance has an influence on power conversion efficiency of the transformer, designers of the conventional transformer endeavor to increase coupling efficiency of the primary and secondary windings of the conventional transformer to reduce the leakage inductance and power loss upon voltage regulation.

Instead of reducing the leakage inductance, a recent development of power supply system in an electronic product actively makes use of the unavoidable leakage inductance. For example, the leakage inductance (L) and a capacitor (C) compose a LC resonant circuit. A soft switch using the LC resonant circuit has reduced damage possibility, minimized noise and improved performance.

With reference to FIGS. 16 and 17, a conventional transformer having adjustable leakage inductance (U.S. Pat. No. 7,236,077) comprises a bobbin 83, a primary winding 81, a secondary winding 82 and a magnetic core assembly 84. The bobbin 83 has a winding section 831 formed on the bobbin 83, and a channel 832 formed through the bobbin 83. The primary winding 81 and the secondary winding 82 are wound around the winding section 831 of the bobbin 83, insulate from each other and are overlapped partially with each other. Part of the magnetic core assembly 84 is mounted into the channel 832 of the bobbin 83. Thus, an overlap region is defined at where the primary winding 81 and the secondary winding 82 are overlapped with each other, and a non-overlap region is defined at where the primary winding 81 and the secondary winding 82 are not overlapped with each other. A leakage inductance of the transformer is adjusted according to an overlap ratio of the overlap region to the sum of the overlap region and the non-overlap region.

In general, the secondary winding is center-tapped and has a connecting terminal protruding from a center of the secondary winding and connected to ground. Therefore, the secondary winding has two coils. When the transformer operates, during one cycle of the electric current, the leakage inductances in the first half cycle and in the later half cycle are caused respectively by the two coils of the secondary winding. Thus, the two sets of leakage inductances easily differ from each other. However, since the coils of the secondary winding can be wound together, distances respectively between the coils and the primary winding are able to be equal to each other and the leakage inductances in the coils of the secondary winding are also the same.

In another aspect, as for a conventional planar transformer, the secondary winding only has one turn, which is a single copper sheet or a copper foil layer formed on a circuit board. If the primary and secondary windings are disposed respectively on two opposite sides of the conventional transformer as in the abovementioned conventional structure, the distances between the two copper-sheeted secondary windings and the primary windings are not the same so the electric currents in the first and later half cycles are not balanced, either.

Moreover, in the conventional planar transformer, although the secondary winding has been replaced with the copper sheet or the copper foil layer on the circuit board, the primary winding of the conventional planar transformer is still made from a conducting wire. The conducting wire is wound in a disc-like form and then the disc-like shape is fixed by applying adhesive to, or a self-adhesive coating on the conducting wire. When the wound conducting wire is assembled into the transformer, it is hard to solder ends of the conducting wire to circuit of the circuit board, and safety distance between the ends of the conducting wire is also difficult to measure.

To overcome the shortcomings, the present invention provides a symmetric planar transformer having adjustable leakage inductance to mitigate or obviate the aforementioned problems.

SUMMARY OF THE INVENTION

The main objective of the present invention is to provide a symmetric planar transformer having adjustable leakage inductance.

The symmetric planar transformer has a circuit board, two first bobbins mounted respectively on opposite side surfaces of the circuit board, two primary windings mounted respectively on the first bobbins, two secondary windings disposed respectively between the circuit board and the first bobbins, two second bobbins disposed respectively between adjacent first bobbins and primary windings, two pad sets disposed respectively between adjacent first bobbins and second bobbins, and a magnetic core assembly mounted through the circuit board, the first and second bobbins, the secondary and primary windings and the pad sets.

Adjusting the numbers of the at least one pad of each pad set also adjusts distances between the primary and secondary windings to allow the secondary windings to have the same leakage. Thus, a balanced electric current is induced.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
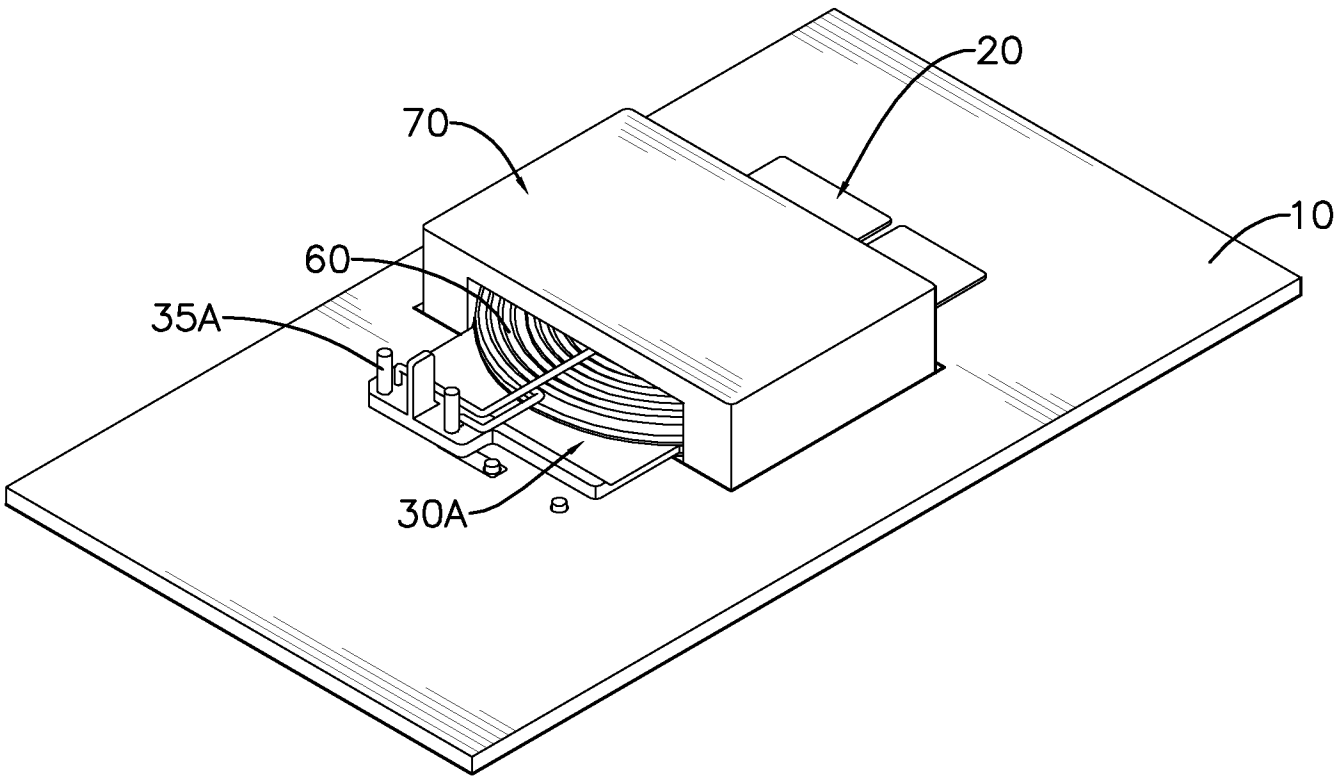
FIG. 1 is a perspective view of a first embodiment of a symmetric planar transformer having adjustable leakage inductance in accordance with the present invention.
Figure 2:
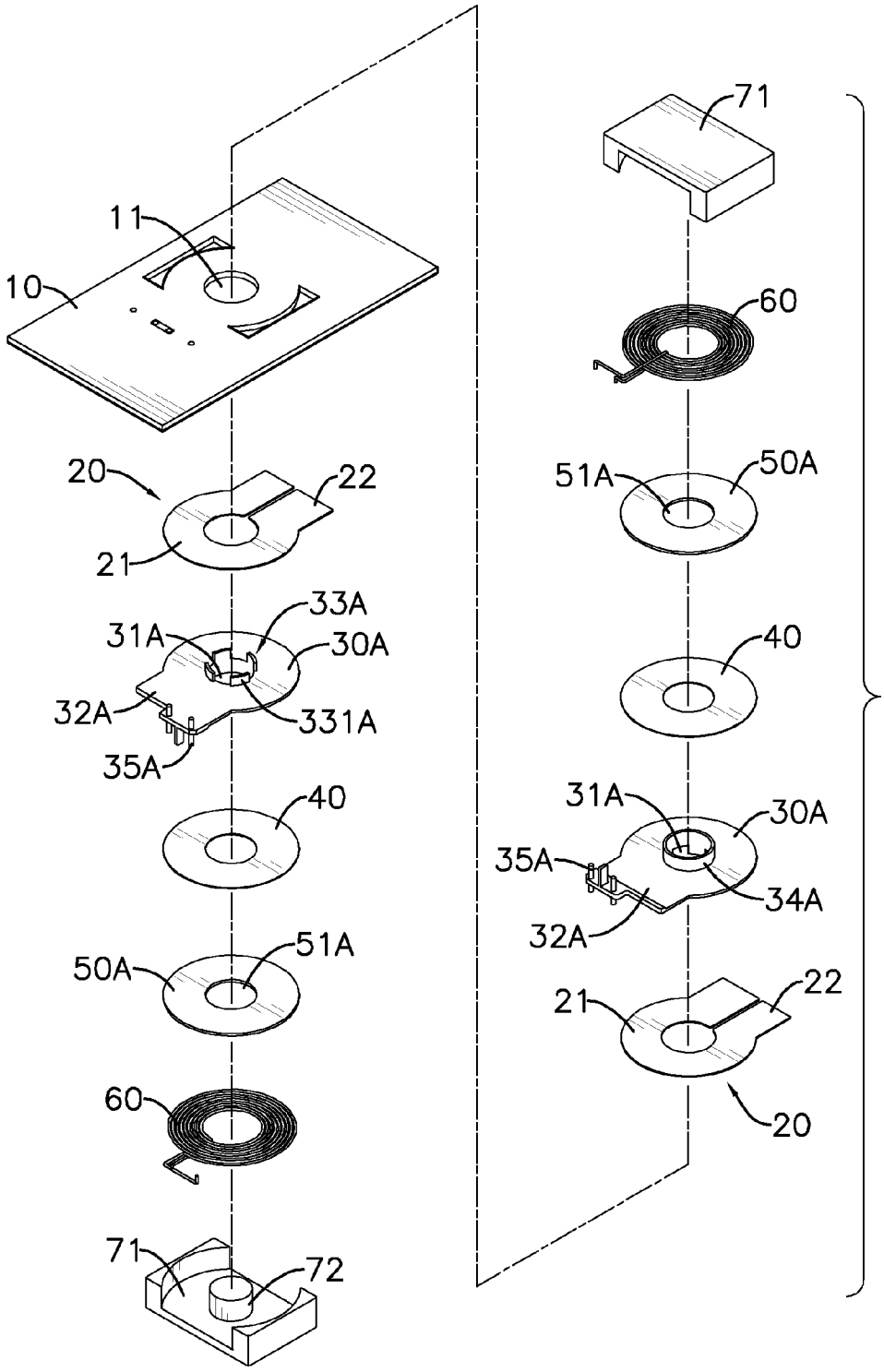
FIG. 2 is an exploded perspective view of the first embodiment of the symmetric planar transformer in FIG. 1.

With reference to FIGS. 1 and 2, a first preferred embodiment of a symmetric planar transformer having adjustable leakage inductance in accordance with the present invention comprises a circuit board 10, two first bobbins 30A, two primary windings 60, two secondary windings 20, two second bobbins 50A, two pad sets 40 and a magnetic core assembly 70.

The circuit board 10 has a circuit and a mounting hole 11. The circuit is formed on the circuit board 10. The mounting hole 11 is formed through the circuit board 10.

Figure 3:
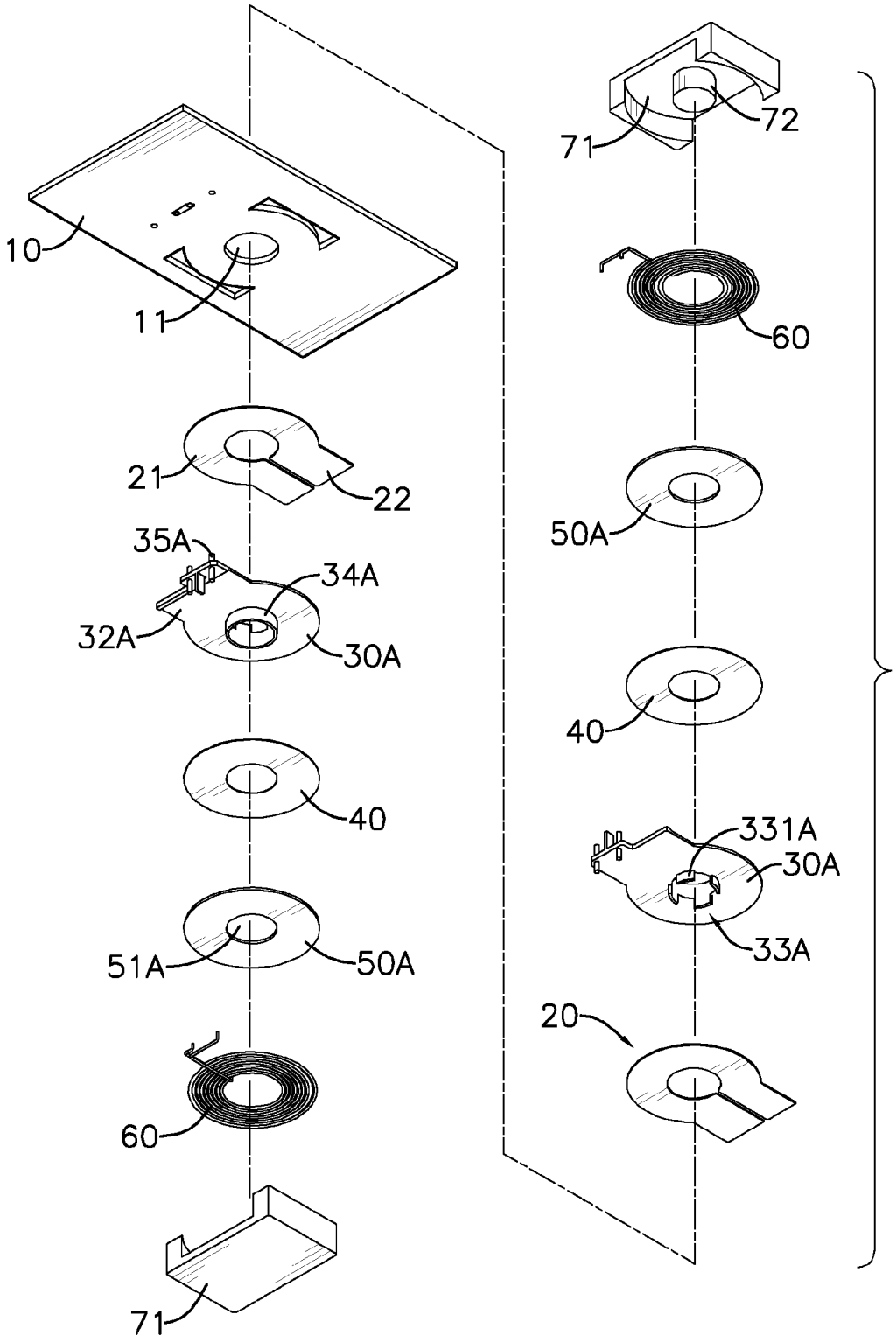
FIG. 3 is another exploded perspective view of the first embodiment of the symmetric planar transformer in FIG. 1.

With further reference to FIG. 3, the first bobbins 30A are mounted respectively on opposite side surfaces of the circuit board 10. Each first bobbin 30A has an inner surface, a through hole 31A, an extending portion 32A, at least one pin 35A, a connecting portion 33A and a mounting tube 34A.

The inner surface of the first bobbin 30A corresponds to the circuit board 10. The through hole 31A of the first bobbin 30A is formed through the first bobbin 30A and aligns with the mounting hole 11 of the circuit board 10.

The extending portion 32A of the first bobbin 30A protrudes from an outer peripheral edge of the first bobbin 30A and has a first side segment and a second side segment. The at least one pin 35A of the first bobbin 30A is mounted through the first side segment of the extending portion 32A of the first bobbin 30A, is offset to the at least one pin 35A of the other first bobbin 30A and is connected electrically to the circuit of the circuit board 10.

The connecting portion 33A is formed on the inner surface of the first bobbin 30A, is mounted through the mounting hole 11 of the circuit board 10, is attached securely to the connecting portion 33A of the other first bobbin 30A. The connecting portions 33A of the first bobbins 30A may be attached to each other with an adhesive. In the first preferred embodiment of the symmetric planar transformer, the connecting portion 33A of each first bobbin 30A may have multiple teeth 331A. The teeth 331A are formed separately around the through hole 31A of the first bobbin 30A and the teeth 331A of the connecting portion 33A of one first bobbin 30A engage the teeth 331A of the connecting portion 33A of the other first bobbin 30A. Thus, the first bobbins 30A do not rotate relative to nor disconnect with each other.

Figure 5:
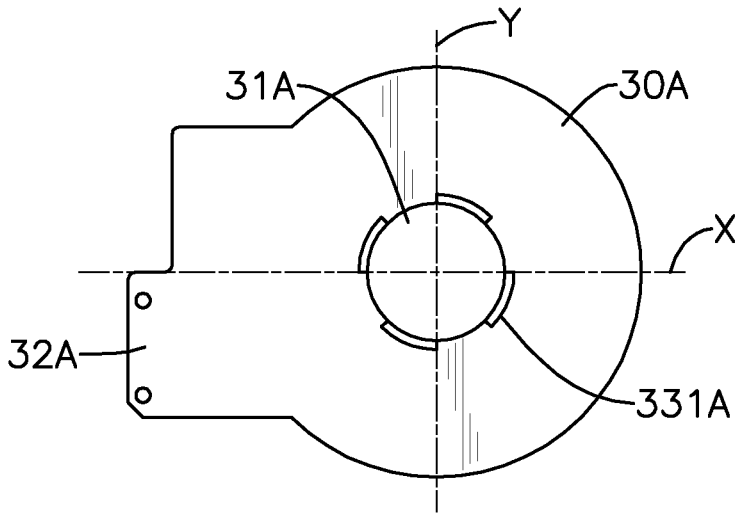
FIG. 5 is a bottom view of a first bobbin of the first embodiment of the symmetric planar transformer in FIG. 1.

Furthermore, with proper arrangement of relative positions of the teeth 331A, the first bobbins 30A may have the same form and the teeth 331A of one first bobbins 30A may be offset to and engage the teeth 331A of the other first bobbin 30A. With further reference to FIG. 5, each first bobbin 30A further has a first axis X and a second axis Y. The first axis X is extended through a middle of the extending portion 32A of the first bobbin 30A. The second axis Y intersects with the first axis X perpendicularly, and each of the first axis X and the second axis Y is divided into two segments. An intersection point of the first axis X and the second axis Y is disposed at a center of the through hole 31A of the first bobbin 30A. The connecting portion 33A of each first bobbin 30A has four teeth 331A arranged respectively by same sides of the segments of the first and second axes X, Y. As shown in FIG. 5, the teeth 331A may be arranged by left sides of the segments of the first and second axes X, Y. Thus, the teeth 331A of the first bobbins 30A are capable of being offset to and engaging each other.

The mounting tube 34A is formed on an outer surface of the first bobbin 30A and around the through hole 31A of the first bobbin 30A.

The primary windings 60 are mounted respectively above and below the outer surfaces of the first bobbins 30A. Each primary winding 60 is a conducting wire, is wound around the mounting tube 34A of a corresponding first bobbin 30A in a disc-like form and has two conducting terminals connected electrically to the circuit of the circuit board 10 through the at least one pin 35A of the corresponding first bobbin 30A. According to arrangement of the circuit of the circuit board 10 and the pin 35A of the first bobbins 30A, the primary windings 60 may be connected to each other to form a parallel or a series circuit.

The secondary windings 20 are disposed respectively between the side surfaces of the circuit board 10 and the first bobbins 30A, are mounted around the mounting hole 11 of the circuit board 10 and the connecting portions 33A of the first bobbins 30A, and are connected electrically to the circuit of the circuit board 10. Each secondary winding 20 may be a copper sheet and has a ring 21, an opening and two connecting protrusions 22. The ring 21 is mounted around the mounting hole 11 of the circuit board 10 and the connecting portions 33A of a corresponding first bobbin 30A, and has two ends. The opening is defined between the ends of the ring 21. The connecting protrusions 22 are respectively extended outwardly from the ends of the ring 21 and are connected electrically to the circuit of the circuit board 10.

Preferably, the connecting protrusions 22 of each secondary winding 20 extend opposite to the extending portion 32A of the corresponding first bobbin 30A. Thus, the circuit board 10 has sufficient room to allow the soldering of the at least one pin 35A of the first bobbin 30A and the connecting protrusion 22 of the secondary winding 20 to the circuit of the circuit board 10.

The second bobbins 50A are circular, are disposed respectively between adjacent first bobbins 30A and primary windings 60 and are mounted respectively around the mounting tubes 34A of the first bobbins 30A. Each second bobbin 50A has an inner surface and a through hole 51A. The inner surface of the second bobbin 50A corresponds to a corresponding first bobbin 30A. The through hole 51A of the second bobbin 50A is formed through the second bobbin 50A and mounted around the mounting tube 34A of the corresponding first bobbin 30A.

Figure 4:
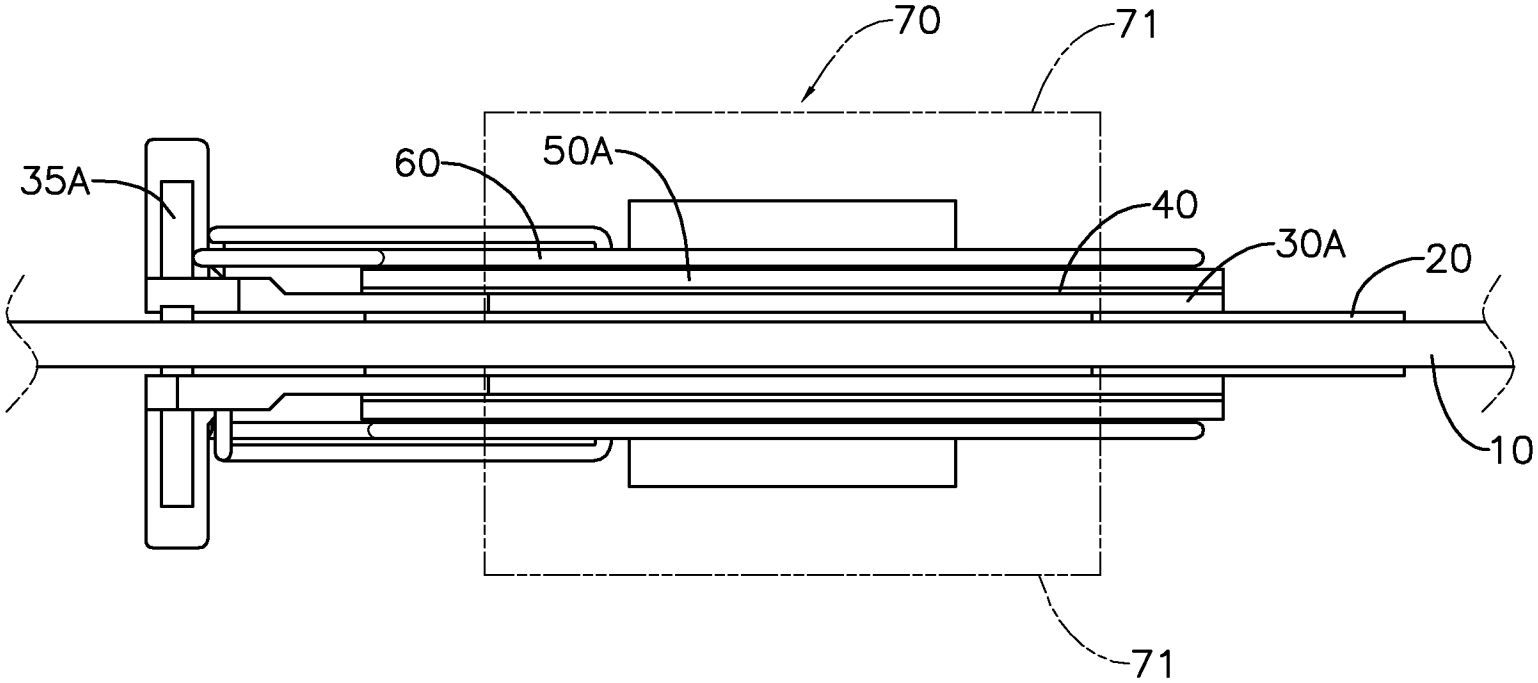
FIG. 4 is an enlarged side view of the first embodiment of the symmetric planar transformer in FIG. 1.

With further reference to FIG. 4, the pad sets 40 are disposed respectively between adjacent first bobbins 30A and second bobbins 50A. Each pad set 40 has at least one pad. Each of the at least one pad is circular, is mounted around the mounting tube 34A of a corresponding first bobbin 30A and may be magnetic materials or non-magnetic materials. Adjusting the numbers of the at least one pad of each pad set 40 also adjusts distances between the primary winding 60 and the secondary winding 20. Consequently, leakage of the symmetric planar transformer is also adjusted.

The magnetic core assembly 70 is mounted through the mounting tubes 34A, the through holes 31A and the connecting portions 33A of the first bobbins 30A and has two magnetic cores 71 mounted respectively on the primary windings 60. Each magnetic core 71 has a core shaft 72 protruding from the magnetic core 71 and mounted through the mounting tube 34A, the through hole 31A and the connecting portion 33A of a corresponding first bobbin 30A. Then, as an input electric current flows into the primary winding 60, an output electric current with transferred voltage is induced into the secondary windings 20 through the magnetic core assembly 70.

Figure 6:
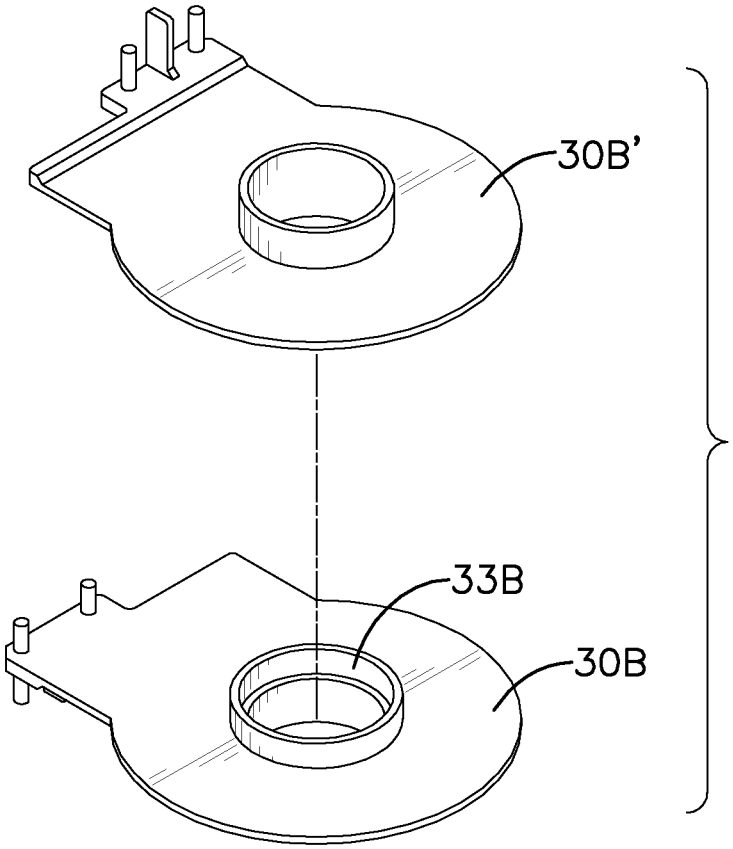
FIG. 6 is an exploded perspective view of first bobbins of a second embodiment of a symmetric planar transformer having adjustable leakage inductance in accordance with the present invention.
Figure 7:
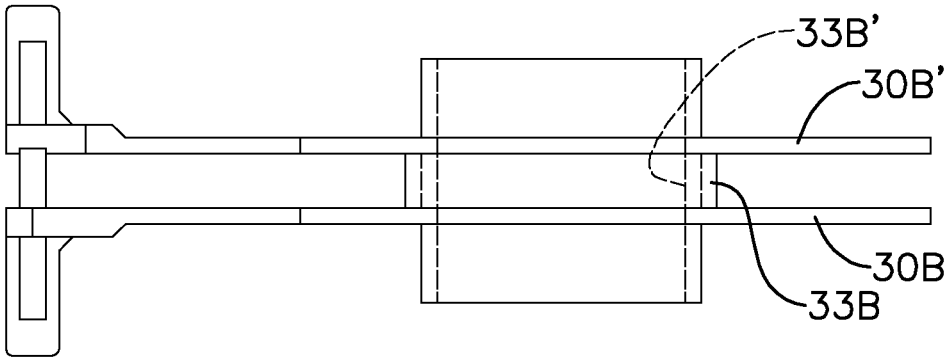
FIG. 7 is a side view of the first bobbins of the second embodiment of the symmetric planar transformer in FIG. 6.

With further reference to FIGS. 6 and 7, in a second preferred embodiment, the first bobbins 30B, 30B' may not be identical to each other in structure. The connecting portion 33B, 33B' of each first bobbin 30B, 30B' is tubular, is formed around the through hole 31A of the first bobbin 30B, 30B' and has an outer diameter and an inner diameter. The inner diameter of the connecting portion 33B of one first bobbin 30B is equal to the outer diameter of the connecting portion 33B' of the other first bobbin 30B'. Thus, the connecting portions 33B, 33B' of the first bobbins 30B, 30B' are mounted around and jointed securely with each other with friction therebetween.

Figure 8:
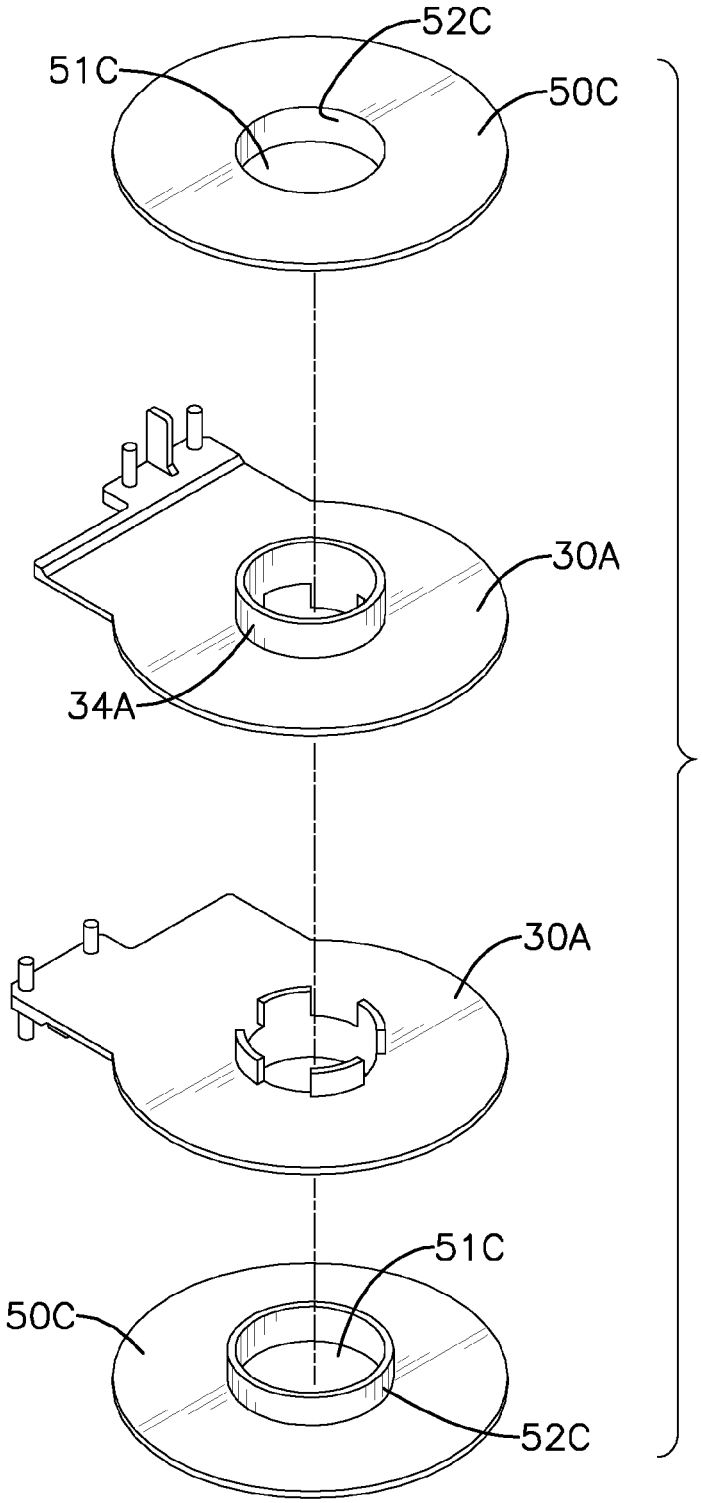
FIG. 8 is an exploded perspective view of first bobbins and second bobbins of a third embodiment of a symmetric planar transformer having adjustable leakage inductance in accordance with the present invention.
Figure 9:
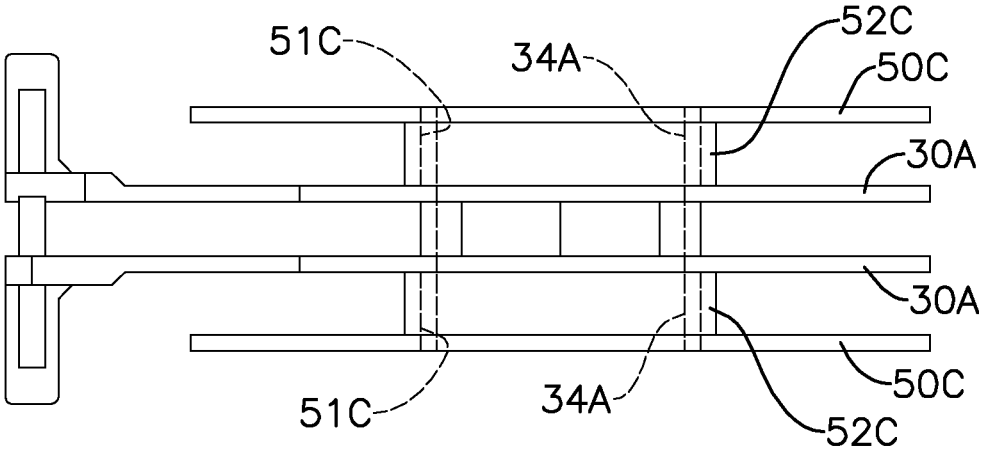
FIG. 9 is a side view of the first bobbins and the second bobbins of the third embodiment of the symmetric planar transformer in FIG. 8.

With further reference to FIGS. 8 and 9, in a third preferred embodiment, each second bobbin 50C further has a partition tube 52C formed on the inner surface of the second bobbin 50C and around the through hole 51C of the second bobbin 50C, and having an inner diameter and a distal edge. The inner diameter of the partition tube 52C is equal to or larger than an outer diameter of the mounting tube 34A of the corresponding first bobbin 30A. The distal edge of the partition tube 52C abuts the corresponding first bobbin 30A to separate the second bobbin 50C from the first bobbin 30A. Thus, the distances between the primary windings 60 and the secondary windings 20 are adjusted according to the height of the partition tube 52C and the pad sets 40 are not required.

Figure 10:
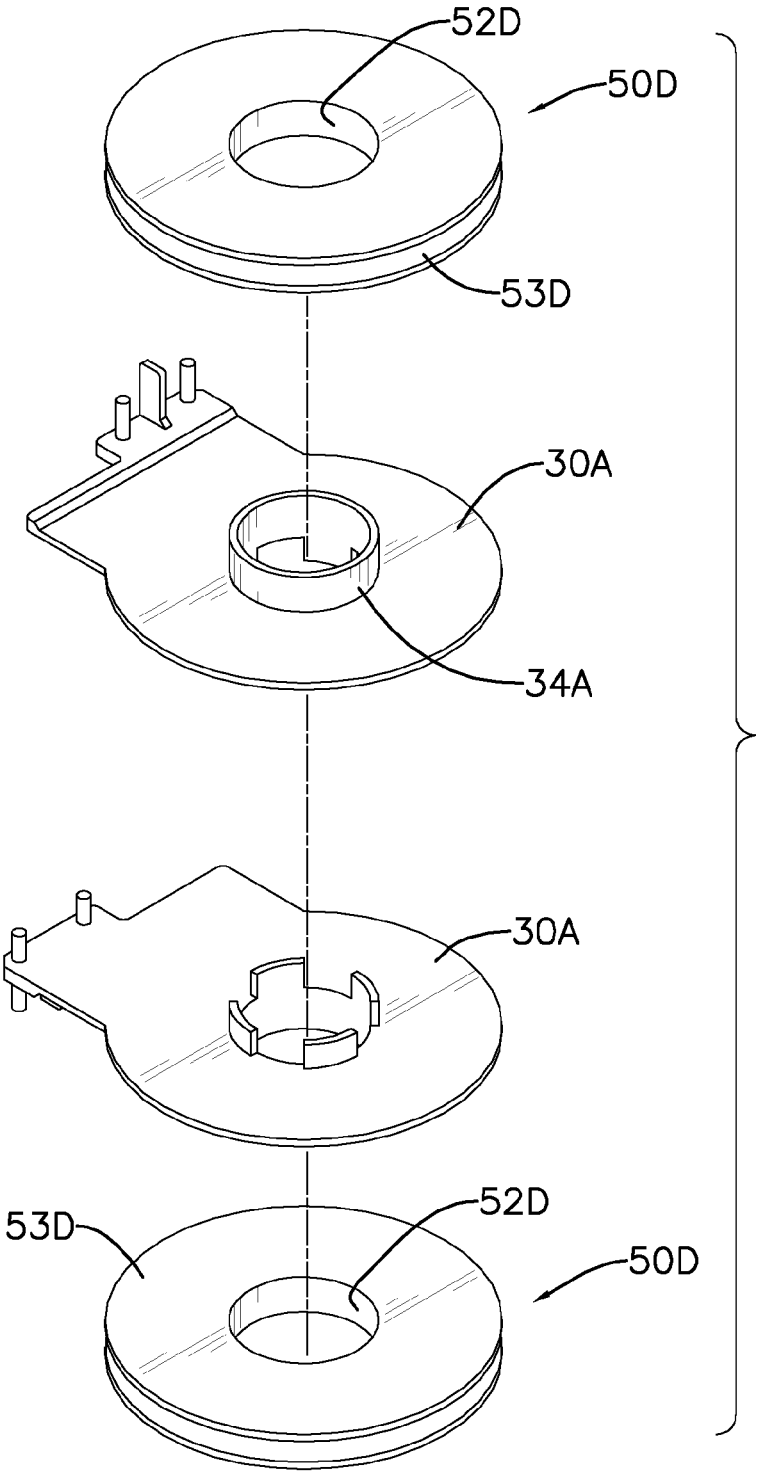
FIG. 10 is an exploded perspective view of first bobbins and second bobbins of a fourth embodiment of a symmetric planar transformer having adjustable leakage inductance in accordance with the present invention.
Figure 11:
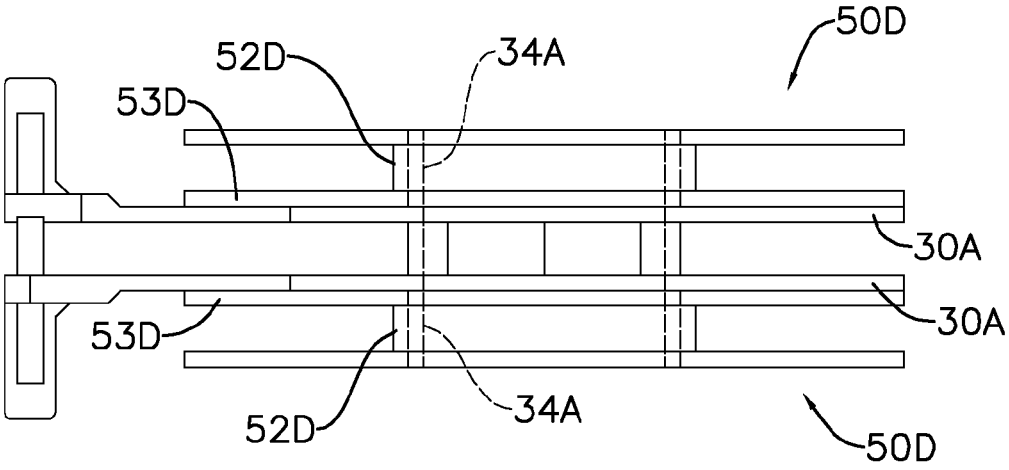
FIG. 11 is a side view of the first bobbins and the second bobbins of the fourth embodiment of the symmetric planar transformer in FIG. 10.

With further reference to FIGS. 10 and 11, in a fourth preferred embodiment, each second bobbin 50D further has a circular panel 53D formed outwardly around the distal edge of the partition tube 52D of the second bobbin 50D. The primary windings 60 are wound respectively around the partition tubes 52D of the second bobbins 50D in advance, and then mounted around the mounting tube 34A of the first bobbin 30A along with the second bobbins 50D. Therefore, the primary windings 60 do not have to be wound into the disc-like form separately, and the winding process is simplified. Moreover, adjusting the numbers of the pads of the pad sets 40 and height of the partition tube 52D of the second bobbin 50D also adjusts the distances between the primary windings 60 and the secondary winding 50.

Figure 12:
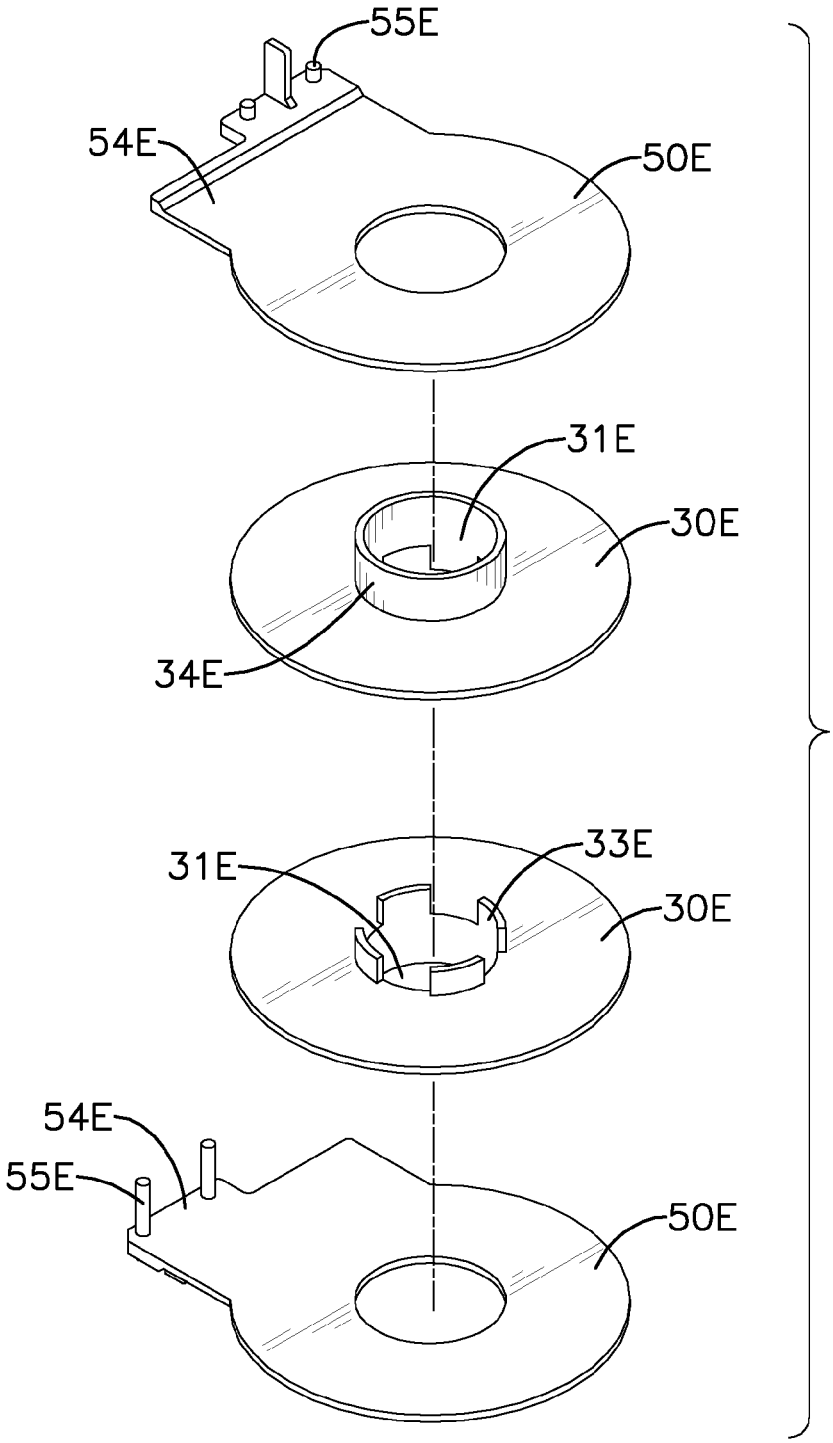
FIG. 12 is an exploded perspective view of first bobbins and second bobbins of a fifth embodiment of a symmetric planar transformer having adjustable leakage inductance in accordance with the present invention.
Figure 13:
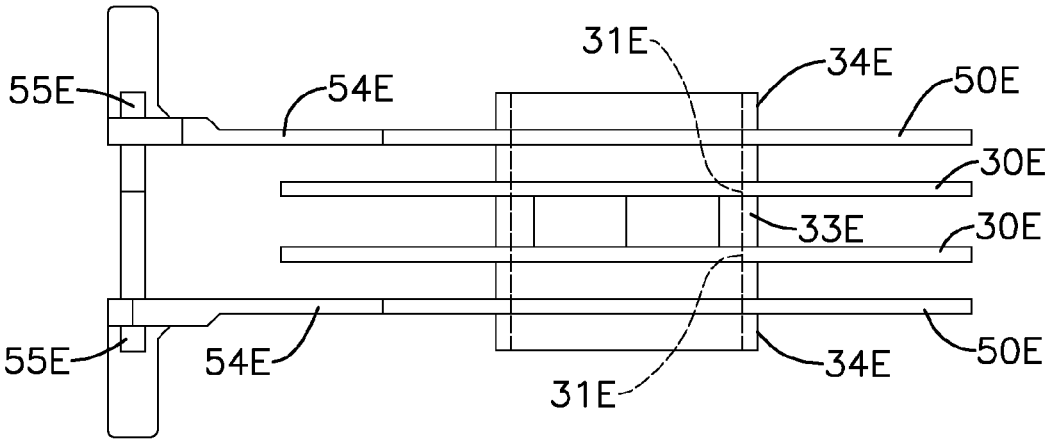
FIG. 13 is a side view of the first bobbins and the second bobbins of the fifth embodiment of the symmetric planar transformer in FIG. 12.

With further reference to FIGS. 12 and 13, in a fifth preferred embodiment, each first bobbin 30E has the through hole 31E, the connecting portion 33E and the mounting tube 34E as described without the extending portion. Instead, each second bobbin 50E further has an extending portion 54E and at least one pin 55E. The extending portion 54E of the second bobbin 50E protrudes from an outer peripheral edge of the second bobbin 50E and has a first side segment and a second side segment. The at least one pin 55E of the first bobbin 50E is mounted through the first side segment of the extending portion 54E of the second bobbin 50E and is connected electrically to the circuit of the circuit board 10.

Figure 14:
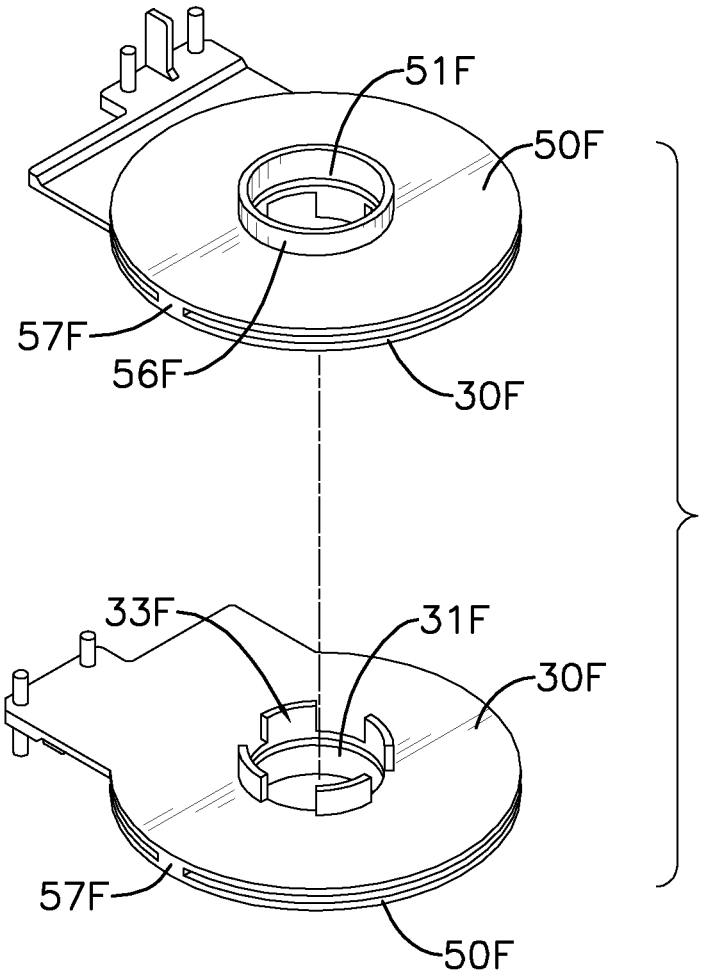
FIG. 14 is an exploded perspective view of first bobbins and second bobbins of a sixth embodiment of a symmetric planar transformer having adjustable leakage inductance in accordance with the present invention.
Figure 15:
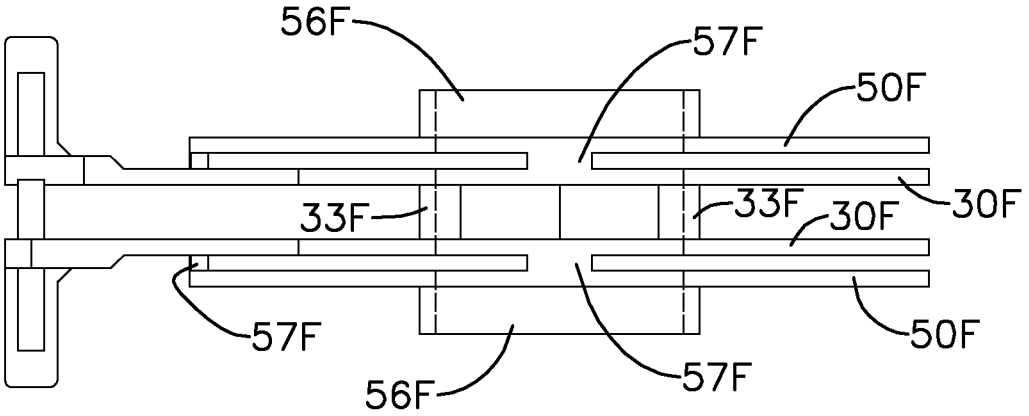
FIG. 15 is a side view of the first bobbins and the second bobbins of the sixth embodiment of the symmetric planar transformer in FIG. 14.
Figure 16:
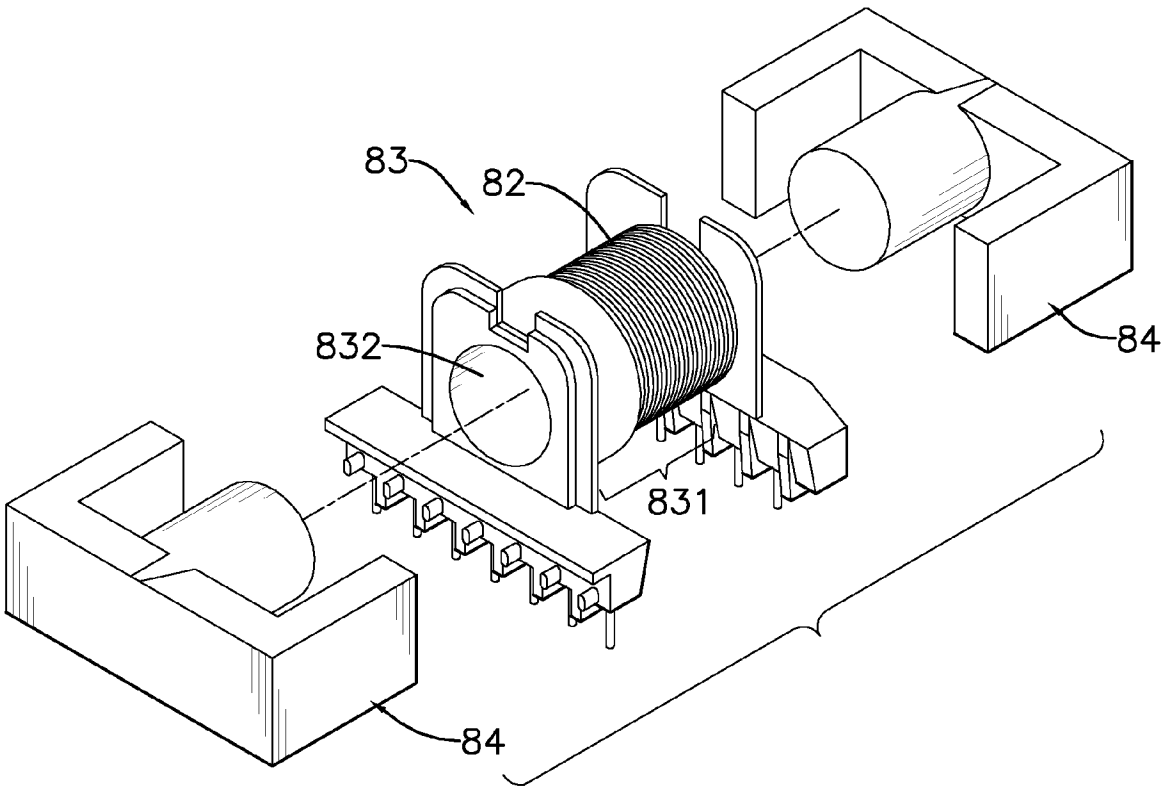
FIG. 16 PRIOR ART
FIG. 16 is an exploded perspective view of a transformer having adjustable leakage inductance in accordance with the prior art.
Figure 17:
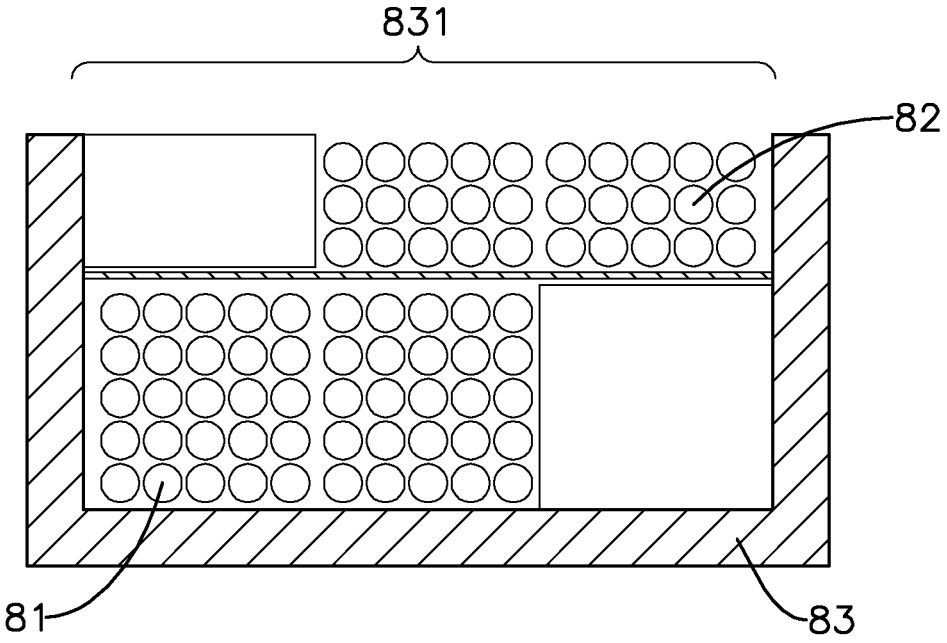
FIG. 17 PRIOR ART
FIG. 17 is an enlarged side view in partial section of the transformer in FIG. 16.

With further reference to FIGS. 14 and 15, in a sixth preferred embodiment, each of the first bobbin 30F has the through hole 31F and the connecting portion 33F. Each of the second bobbin 50F is separated from the corresponding first bobbin 30F, comprises the through hole 51F and further has a mounting tube 56F and multiple attaching portions 57F. The through hole 51F of the second bobbin 50F is formed through the second bobbin 50F and aligns with the through hole 31F of the corresponding first bobbin 30F. The mounting tube 56F of the second bobbin 50F is formed on an outer surface of the second bobbin 50F and around the through hole 51F of the second bobbin 50F. The attaching portions 57F are formed separately on the outer peripheral edge of the second bobbin 50F and are attached securely to the outer peripheral edge of the corresponding first bobbin 30F.

Thus, the pad sets 40 having the needed materials are mounted respectively between the adjacent first bobbins 30F and second bobbins 50F, and the primary windings 60 are wound around the mounting tubes 56F of the second bobbins 50F in advance. Then mounting of the first and second bobbins 30F, 50F, the pad set 40 and the primary winding 60 can be done at the same time. Consequently, winding process of the primary windings 60 and assembling the symmetric planar transformer are simplified. Furthermore, since heights of the attaching portions 57F determine the distances between the first and second bobbins 30F, 50F and the distances between the secondary and primary windings 20, 60 accordingly, the pad sets 40 is not required. Moreover, the sixth preferred embodiment of the symmetric planar transformer is especially for a transformer having a pre-determined distance between the primary winding 60 and the secondary winding 50.

Furthermore, positions of the above mentioned primary windings 20 and secondary windings 60 are exchangeable.

The symmetric planar transformer as described has the following advantages. The first and second bobbins 30A, 30B, 30B', 30E, 30F, 50A, 50C, 50D, 50E, 50F allow easy assembling of the secondary windings 20, the pad sets 40 and the primary windings 60. Moreover, the distances between the secondary windings 20 and the primary windings 60 are easily adjusted as the same so the secondary windings 20 are symmetric to the primary windings 60 and have the same leakage inductance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A symmetric planar transformer comprising a circuit board having a circuit formed on the circuit board; and a mounting hole formed through the circuit board;

two first bobbins mounted respectively on opposite side surfaces of the circuit board, and each first bobbin having an inner surface corresponding to the circuit board;

a through hole formed through the first bobbin and aligning with the mounting hole of the circuit board;

a connecting portion formed on the inner surface of the first bobbin, mounted through the mounting hole of the circuit board, attached securely to the connecting portion of the other first bobbin; and a mounting tube formed on an outer surface of the first bobbin and around the through hole of the first bobbin;

two primary windings mounted respectively above and below the outer surfaces of the first bobbins, and each primary winding being a conducting wire, wound around the mounting tube of a corresponding first bobbin in a disc-like form and having two conducting terminals connected electrically to the circuit of the circuit board;

two secondary windings disposed respectively between the side surfaces of the circuit board and the first bobbins, mounted around the mounting hole of the circuit board and the connecting portions of the first bobbins, and connected electrically to the circuit of the circuit board; and a magnetic core assembly mounted through the mounting tubes, the through holes and the connecting portions of the first bobbins.

2. The symmetric planar transformer as claimed in claim 1 further comprising two second bobbins being circular, disposed respectively between adjacent first bobbins and primary windings and mounted respectively around the mounting tubes of the first bobbins, and each second bobbin having a through hole formed through the second bobbin and mounted around the mounting tube of a corresponding first bobbin; and two pad sets disposed respectively between adjacent first bobbins and second bobbins, and each pad set having at least one pad being circular and mounted around the mounting tube of a corresponding first bobbin.

3. The symmetric planar transformer as claimed in claim 2, wherein the connecting portion of each first bobbin has multiple teeth formed separately around the through hole of the first bobbin, and the teeth of the connecting portion of one first bobbin engaging the teeth of the connecting portion of the other first bobbin.

4. The symmetric planar transformer as claimed in claim 2, wherein the connecting portion of each first bobbin is tubular, is formed around the through hole of the first bobbin and has an outer diameter; and an inner diameter, and the inner diameter of the connecting portion of one first bobbin being equal to the outer diameter of the connecting portion of the other first bobbin;

thereby the connecting portions of the first bobbins are mounted around and jointed securely with each other.

5. The symmetric planar transformer as claimed in claim 1 further comprising two second bobbins being circular, disposed respectively between adjacent first bobbins and primary windings and mounted respectively around the mounting tubes of the first bobbins, and each second bobbin having an inner surface corresponding to a corresponding first bobbin;

a through hole formed through the second bobbin and mounted around the mounting tube of the corresponding first bobbin; and a partition tube formed on the inner surface of the second bobbin and around the through hole of the second bobbin, and having an inner diameter being equal to or larger than an outer diameter of the mounting tube of the corresponding first bobbin; and a distal edge abutting the corresponding first bobbin.

6. The symmetric planar transformer as claimed in claim 2, wherein each second bobbin further has an inner surface corresponding to the corresponding first bobbin;

a partition tube formed on the inner surface of the second bobbin and around the through hole of the second bobbin, and having an inner diameter being equal to or larger than an outer diameter of the mounting tube of the corresponding first bobbin; and a distal edge abutting the corresponding first bobbin; and a circular panel formed outwardly around the distal edge of the partition tube of the second bobbin; and the primary windings are wound respectively around the partition tubes of the second bobbins.

7. The symmetric planar transformer as claimed in claim 3, wherein each second bobbin further has an inner surface corresponding to the corresponding first bobbin;

a partition tube formed on the inner surface of the second bobbin and around the through hole of the second bobbin, and having an inner diameter being equal to or larger than an outer diameter of the mounting tube of the corresponding first bobbin; and a distal edge abutting the corresponding first bobbin; and a circular panel formed outwardly around the distal edge of the partition tube of the second bobbin; and the primary windings are wound respectively around the partition tubes of the second bobbins.

8. The symmetric planar transformer as claimed in claim 4, wherein each second bobbin further has an inner surface corresponding to the corresponding first bobbin;

a partition tube formed on the inner surface of the second bobbin and around the through hole of the second bobbin, and having an inner diameter being equal to or larger than an outer diameter of the mounting tube of the corresponding first bobbin; and a distal edge abutting the corresponding first bobbin; and a circular panel formed outwardly around the distal edge of the partition tube of the second bobbin; and the primary windings are wound respectively around the partition tubes of the second bobbins.

9. The symmetric planar transformer as claimed in claim 3, wherein each first bobbin has an extending portion protruding from an outer peripheral edge of the first bobbin;

a first axis X extended through a middle of the extending portion of the first bobbin; and a second axis Y intersecting with the first axis X perpendicularly, and each of the first axis X and the second axis Y being divided into two segments;

an intersection point of the first axis X and the second axis Y is disposed at a center of the through hole of the first bobbin; and the connecting portion of each first bobbin has four teeth arranged respectively by the same sides of the segments of the first and second axes.

* * * * *